US010475430B2

(12) United States Patent
Motohashi et al.

(10) Patent No.: US 10,475,430 B2
(45) Date of Patent: Nov. 12, 2019

(54) HI-HAT CYMBAL SOUND GENERATION APPARATUS, HI-HAT CYMBAL SOUND GENERATION METHOD, AND RECORDING MEDIUM

(71) Applicant: KORG INC., Tokyo (JP)

(72) Inventors: Haruhiko Motohashi, Tokyo (JP); Masahiko Akino, Tokyo (JP); Tatsuya Nishikawa, Tokyo (JP)

(73) Assignee: KORG INC., Tokyo (JP)

( * ) Notice: Subject to any disclaimer, the term of this patent is extended or adjusted under 35 U.S.C. 154(b) by 0 days.

(21) Appl. No.: 16/209,216

(22) Filed: Dec. 4, 2018

(65) Prior Publication Data

US 2019/0180727 A1 Jun. 13, 2019

(30) Foreign Application Priority Data

Dec. 7, 2017 (JP) ..... 2017-235175

(51) Int. Cl.

*G10H 3/14* (2006.01)
*G10H 3/00* (2006.01)
*G10H 1/02* (2006.01)

(52) U.S. Cl.

CPC ..... *G10H 3/146* (2013.01); *G10H 1/02* (2013.01); *G10H 2230/331* (2013.01); *G10H 2250/435* (2013.01)

(58) Field of Classification Search

CPC ..... G10H 1/46; G10H 2230/331; G10H 2230/305; G10H 2230/325; H04R 17/00
See application file for complete search history.

(56) References Cited

U.S. PATENT DOCUMENTS

2005/0150349 A1* 7/2005 Susami ..... G10H 3/146 84/299
2006/0156910 A1* 7/2006 Yoshino ..... G10H 1/34 84/723
2009/0139387 A1* 6/2009 Toda ..... G10H 1/348 84/422.3
2009/0183627 A1 7/2009 Susami
(Continued)

FOREIGN PATENT DOCUMENTS

JP 2005195981 7/2005
JP 2009080444 4/2009

*Primary Examiner* — Marlon T Fletcher
(74) *Attorney, Agent, or Firm* — Greenblum & Bernstein, P.L.C.

(57) ABSTRACT

A hi-hat cymbal sound generation apparatus according to the present invention includes an input part, a recording part, a trigger part and a sound volume control part. The input part acquires distance information on a distance between a top pad and a bottom pad, state information and vibration information on a vibration of the top pad. The input part acquires the state information by determining the state information based on a corrected distance, which is obtained by adding a distance correction value, which corresponds to a magnitude of the vibration indicated by the vibration information, to the distance indicated by the distance information. The recording part records data on a hit sound in each state indicated by the state information. The trigger part checks whether the vibration indicated by the vibration information falls within a predetermined range in which a sound generation procedure is to be started.

9 Claims, 11 Drawing Sheets

(56) References Cited

U.S. PATENT DOCUMENTS

| | | | | |
|---|---|---|---|---|
| 2013/0125735 | A1* | 5/2013 | Mori | G10H 3/146 84/723 |
| 2013/0145923 | A1* | 6/2013 | Susami | G10H 1/348 84/622 |
| 2019/0156798 | A1* | 5/2019 | Motohashi | G10D 13/065 |
| 2019/0180727 | A1* | 6/2019 | Motohashi | G10H 3/146 |

* cited by examiner

HI-HAT CYMBAL SOUND GENERATION APPARATUS, HI-HAT CYMBAL SOUND GENERATION METHOD, AND RECORDING MEDIUM

TECHNICAL FIELD

The present invention relates to a hi-hat cymbal sound generation apparatus that generates a hi-hat cymbal sound, a hi-hat cymbal sound generation method, and a recording medium.

BACKGROUND ART

Prior arts disclosed in Japanese Patent Application Laid-Open Nos. 2005-195981 (Patent Literature 1) and 2009-80444 (Patent Literature 2) are known arts for generating a pseudo hi-hat cymbal sound.

SUMMARY OF THE INVENTION

However, these arts have a problem that players feel that the change of sound in response to their operation is different from that of the real hi-hat cymbals. In particular, in the paragraph 0017 in Patent Literature 2, it is pointed out that "With the electronic hi-hat cymbals described above, if the top cymbal is hit hard with a stick or the like with the foot pedal not being pressed down hard, the top cymbal moves down". This means that the distance between the top cymbal and the bottom cymbal decreases. Furthermore, in Patent Literature 2, it is pointed out that, with the art disclosed in Patent Literature 1, "the cymbal sound can disappear without the player's intention" when the top cymbal is hit hard with a stick or the like. A solution to the problem described in the paragraph 0031 is as follows: "The first timer means measures time from the time when the hitting detection means detects a hitting on the hitting surface, and the control means prevents a tone stop instruction from the tone stop instruction means until the time measured by the first timer means reaches a predetermined time. Therefore, even if the top cymbal moves down in response to a hitting on the top cymbal, the tone generated by the hitting is controlled not to be stopped for the predetermined time".

With the real hi-hat cymbals, however, if the player hits the cymbals hard in a state other than the close state, a sound closer to the sound in the open state than when the cymbals are lightly hit (a sound in a state where the distance between the top cymbal and the bottom cymbal is slightly greater) is generated. That is, according to the solution of preventing the tone stop instruction, the sound generated is different from the sound of the real hi-hat cymbals. In view of such circumstances, an object of the present invention is to bring a sound caused by hitting by a player closer to the sound of the real hi-hat cymbals.

A hi-hat cymbal sound generation apparatus according to the present invention generates a sound of hi-hat cymbals based on information on an operation to a top pad, which corresponds to a top cymbal, and a bottom pad, which corresponds to a bottom cymbal, and the top pad and the bottom pad are attached to a hi-hat stand with a pedal. A distance between the top pad and the bottom pad is capable of being changed by an operation of the pedal. State information is information that indicates which of a predetermined number of states a state is, and the state is determined by the distance between the top pad and the bottom pad. Of the states, a state in which the top pad and the bottom pad are closest to each other is designated as a close state. The hi-hat cymbal sound generation apparatus comprises an input part, a recording part, a trigger part, and a sound volume control part. The input part acquires distance information on a distance between a top pad and a bottom pad, state information and vibration information on a vibration of the top pad. The input part acquires the state information by determining the state information based on a corrected distance, which is obtained by adding a distance correction value, which corresponds to a magnitude of the vibration indicated by the vibration information, to the distance indicated by the distance information. The recording part records at least data on a predetermined number of hit sounds that correspond to sounds generated by hitting in states indicated by the state information. The trigger part checks whether the vibration indicated by the vibration information falls within a predetermined range in which a sound generation procedure is to be started, and starts sound generation procedures for all the hit sounds when the trigger part determines that the vibration falls within the range in which a sound generation procedure is to be started. The sound volume control part controls a sound volume of each hit sound based on the current state information.

With the real hi-hat cymbals, when the top cymbal is hit hard in a state other than the close state, the generated sound is shifted toward the sound in the open state from the sound in the actual state. Thus, the input part of the hi-hat cymbal sound generation apparatus according to the present invention acquires the state information by determining the state information based on the corrected distance, which is obtained by adding the distance correction value, which corresponds to the magnitude of the vibration indicated by the vibration information, to the distance indicated by the distance information. Therefore, the present invention can provide a sound closer to the sound of the real hi-hat cymbals than prior art.

DETAILED DESCRIPTION OF THE EMBODIMENTS

Figure 1:
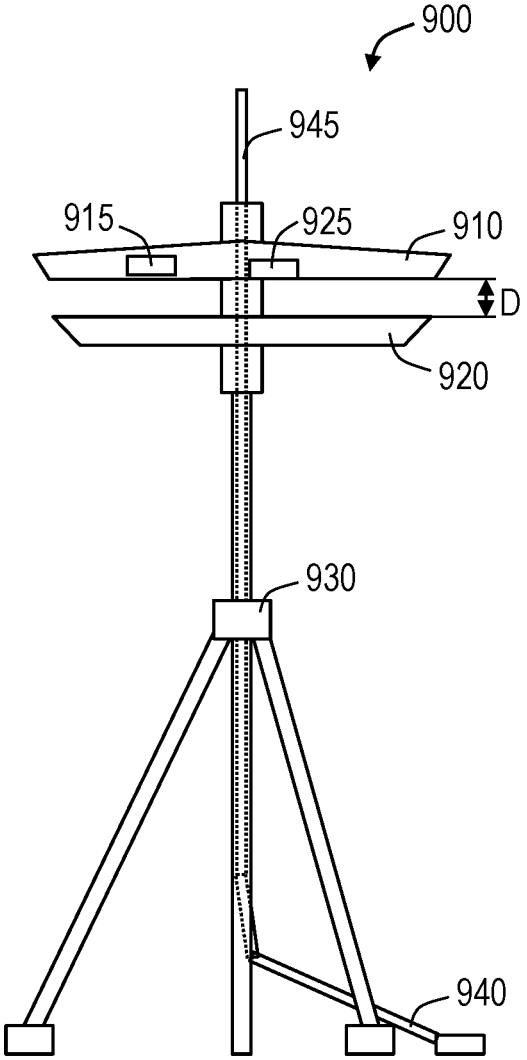
FIG. 1 is a diagram showing a configuration of electronic hi-hat cymbals.

In the following, embodiments of the present invention will be described in detail. Components having the same function are denoted by the same reference numeral, and redundant description thereof will be omitted.

First Embodiment

<Introduction>

FIG. 1 shows a configuration of electronic hi-hat cymbals. Electronic hi-hat cymbals 900 include a hi-hat stand 930 with a pedal 940, and a top pad 910 corresponding to a top cymbal and a bottom pad 920 corresponding to a bottom cymbal attached to the hi-hat stand 930. The top pad 910 is fixed to a shaft 945 of the hi-hat stand 930, and the shaft 945 is coupled to the pedal 940 at one end thereof. In response to an operation of the pedal 940, the shaft 945 moves up and down, and therefore, the top pad 910 also moves up and down. More specifically, the top pad 910 moves down when the pedal 940 is pressed, and moves up when the pedal 940 is released. Therefore, a distance D between the top pad 910 and the bottom pad 920 can be changed by an operation of the pedal 940. The top pad 910 is provided with a vibration sensor 915 that detects a vibration, and a distance sensor 925 that detects the distance D between the top pad 910 and the bottom pad 920. The vibration sensor and the distance sensor may be arranged at different locations.

A predetermined number N of states are previously set as states that depend on the distance D between the top pad 910 and the bottom pad 920. State information is information that indicates which of those states is relevant. N denotes an integer equal to or greater than 3. Of these states, a state where the top pad 910 and the bottom pad 920 are closest to each other is referred to as a close state, a state where the pads are farthest from each other is referred to as an open state, and the other states are referred to as a half-open state. The number N of the states can be the number of different sounds discernible to the human ear that are caused by the change of the distance D. The way of division into the N states depending on the distance D can be determined based on the difference in sound of the real hi-hat cymbals. For example, N=8 can be set, and the distance D can be divided at narrower intervals at the close state and half-open states closer to the close state and at wider intervals at half-open states closer to the open state.

<Configuration and Characteristics of Hi-Hat Cymbal Sound Generation Apparatus>

Figure 2:
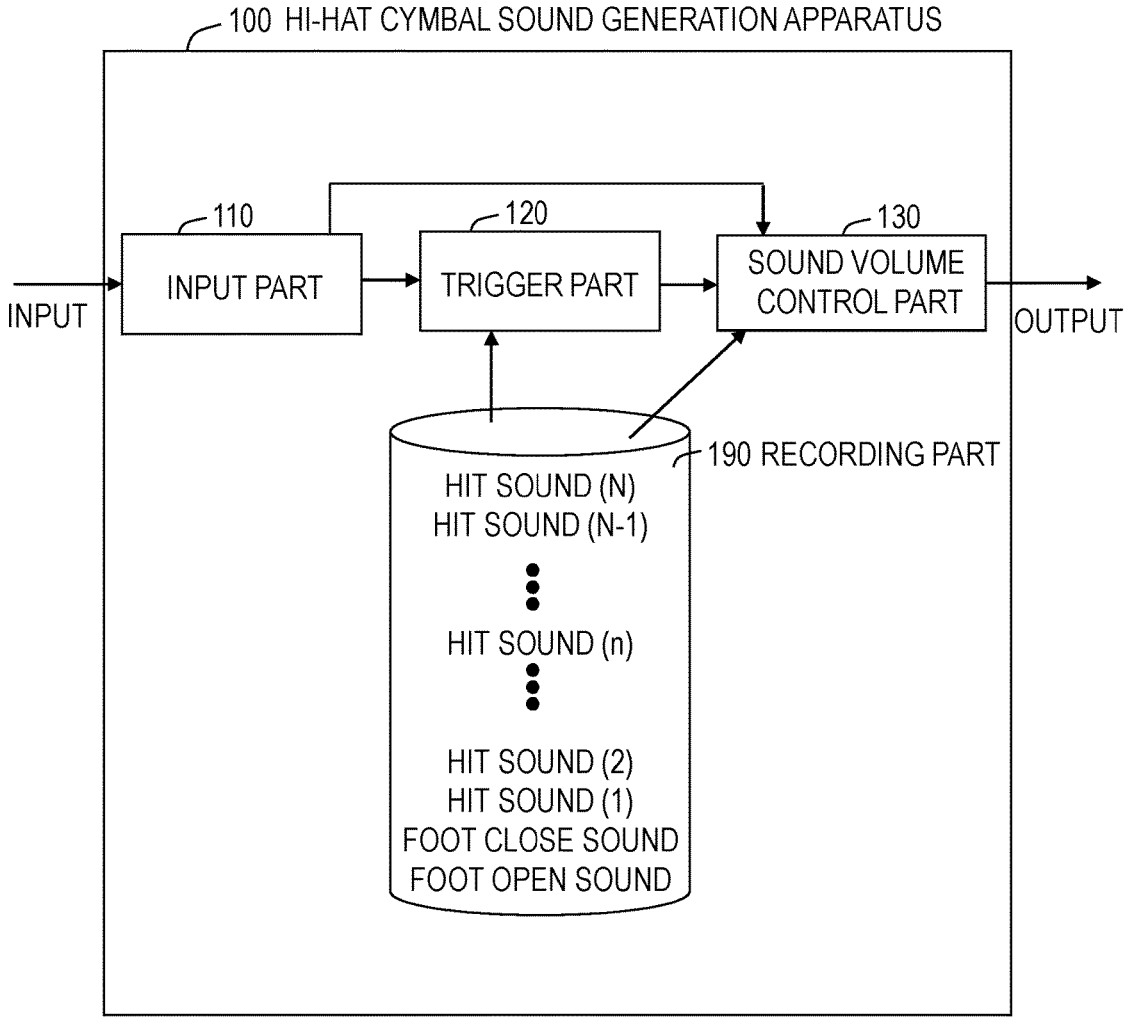
FIG. 2 is a diagram showing an example of a functional configuration of a hi-hat cymbal sound generation apparatus according to the present invention.
Figure 3:
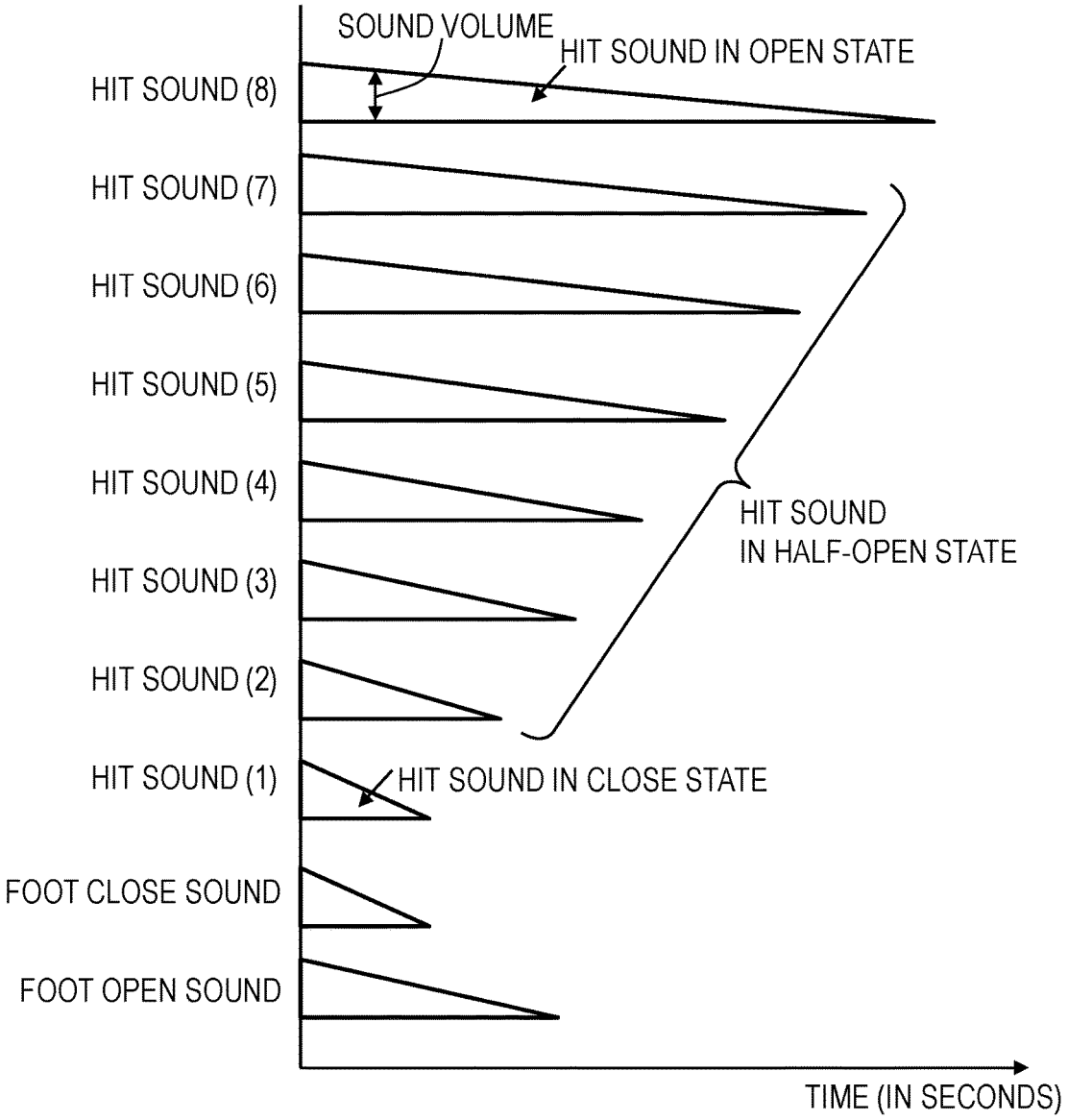
FIG. 3 shows a graphical image of sound data recorded in a recording part 190.
Figure 4:
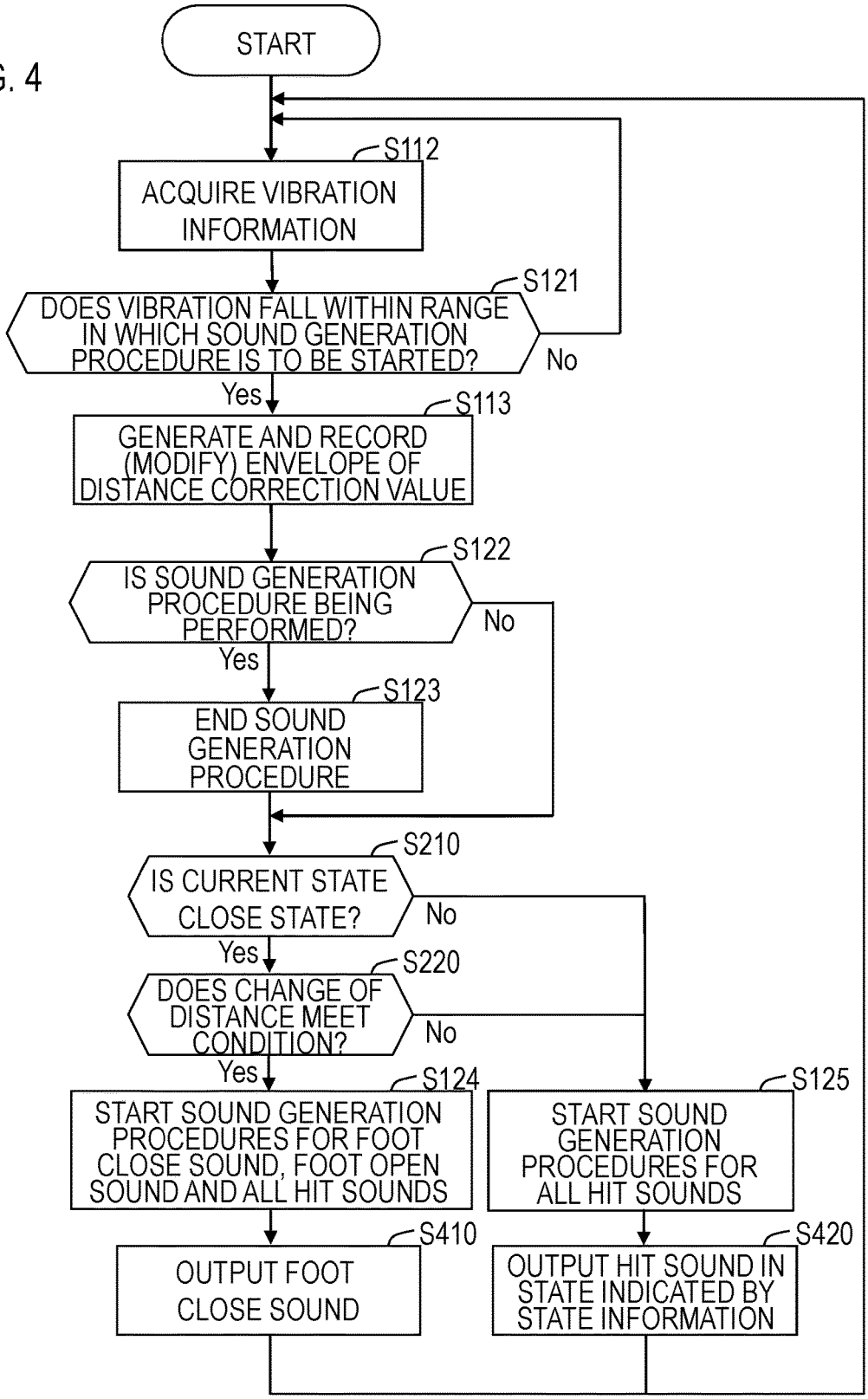
FIG. 4 is a diagram showing an example of a flow of a process in which vibration information is acquired and a sound generation procedure is started.
Figure 5:
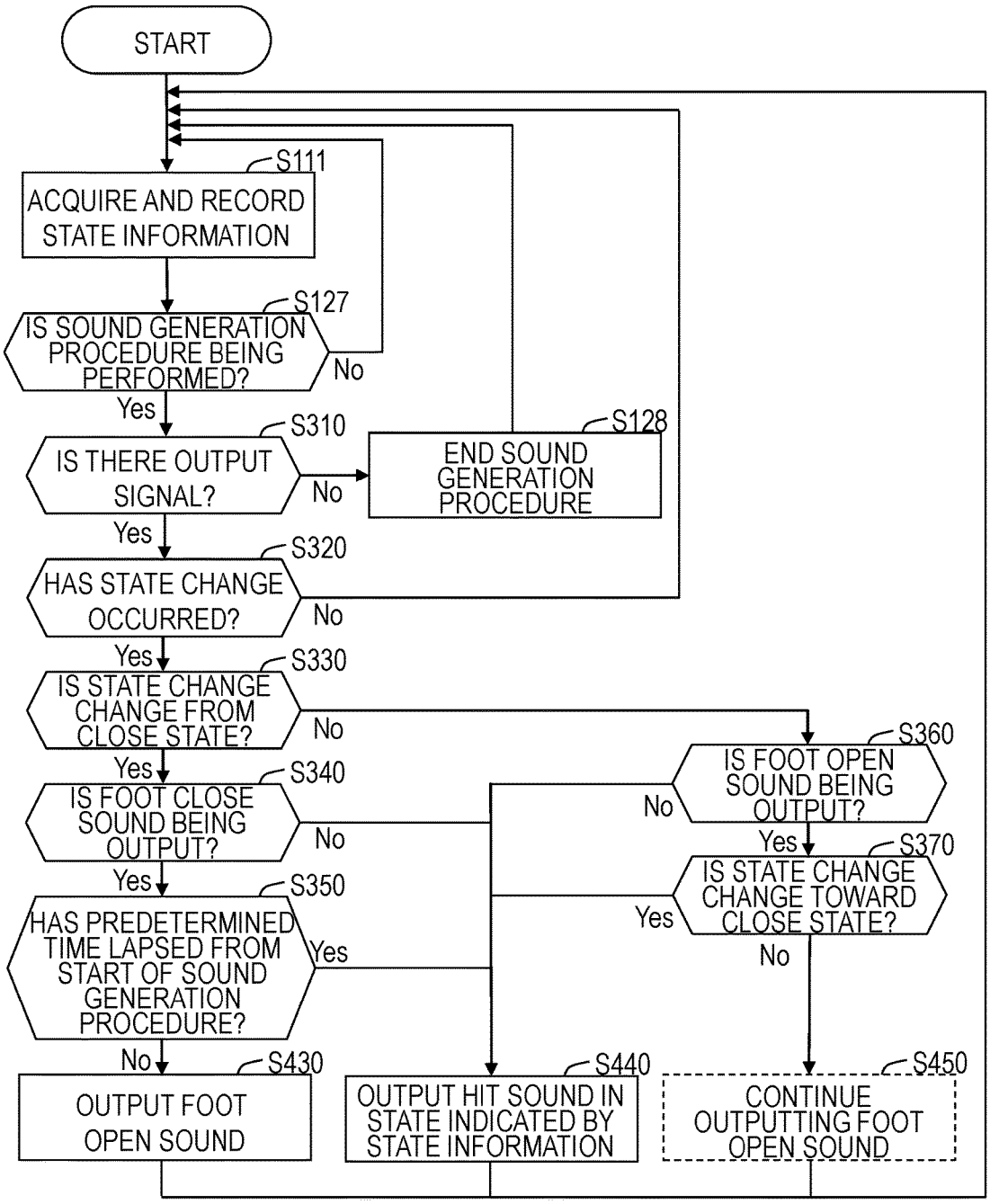
FIG. 5 is a diagram showing an example of a flow of a process in which state information is acquired and a sound generation procedure is being performed.
Figure 6:
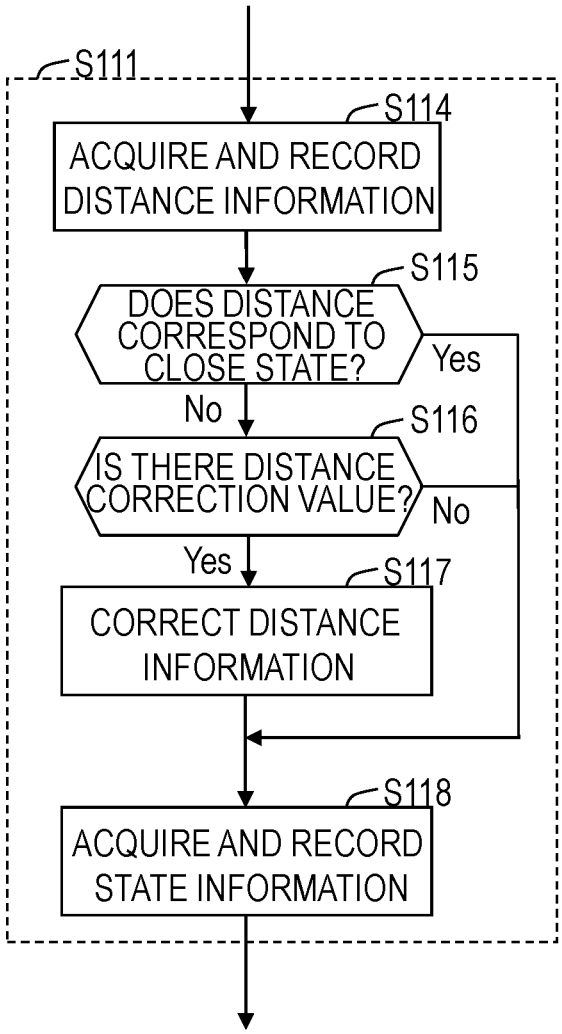
FIG. 6 is a diagram showing an example of a flow of a process in which state information is acquired and recorded.

FIG. 2 shows an example of a functional configuration of a hi-hat cymbal sound generation apparatus according to the present invention. A hi-hat cymbal sound generation apparatus 100 includes an input part 110, a recording part 190, a trigger part 120, and a sound volume control part 130. FIG. 3 shows a graphical image of sound data recorded in the recording part 190. FIG. 4 shows an example of a flow of a process in which vibration information is acquired and a sound generation procedure is started. FIG. 5 shows an example of a flow of a process in which state information is acquired and a sound generation procedure is being performed. FIG. 6 shows an example of a flow of a process in which state information is acquired and recorded.

The input part 110 acquires distance information, which is information on the distance D between the top pad 910 and the bottom pad 920, state information, and vibration information, which is information on a vibration of the top pad 910 (S111, S112, S114). The distance information can be acquired from a distance sensor 925. The vibration information can be acquired from a vibration sensor 915. The input part 110 can repeat the processing. For example, the input part 110 may perform the processing every 5 ms, every 10 ms, or every 20 ms, for example. The distance information and the vibration information may be acquired at the same time, or may be acquired at different times at different intervals. For example, the vibration information can be acquired every 2 ms, and the distance information can be acquired every 5 ms or 10 ms.

The input part 110 acquires the state information by determining the state information based on a corrected distance, which is obtained by adding a distance correction value, which corresponds to the magnitude of the vibration indicated by the vibration information, to the distance indicated by the distance information (S111). This processing will be described with reference to FIG. 6. The input part 110 acquires the distance information as described above, and record the distance information (S114). The input part 110 checks whether the distance indicated by the acquired distance information corresponds to the close state (S115). The input part 110 checks whether information on the distance correction value described later is recorded in the recording part 190 (S116). If the current state is not the close state, and the distance correction value is recorded in the recording part 190 (No in S115 and Yes in S116), the distance correction value is added to the distance indicated by the distance information, and the resulting value is designated as the corrected distance (S117). If the current state is the close state or if the distance correction value is not recorded in the recording part 190 or the distance correction value is 0 (Yes in S115 or No in S116), the distance indicated by the acquired distance information is designated as the corrected distance. The input part 110 acquires the state information by determining the state information that indicates the state corresponding to the corrected distance, and records the state information (S118).

The recording part 190 records data on a foot close sound, which corresponds to a sound in the close state that is generated when the top cymbal and the bottom cymbal come into contact with each other in response to operation of the pedal, data on a foot open sound, which corresponds to a sound in a state other than the close state that is generated when the top cymbal and the bottom cymbal come into contact with each other in response to operation of the pedal, and data on the predetermined number of hit sounds, which correspond to sounds generated when the cymbals are hit in states indicated by the state information. In other words, the foot close sound corresponds to a sound that is generated by the top cymbal hitting the bottom cymbal in response to operation of the pedal. The foot open sound corresponds to a sound that is generated when the top cymbal is taken off the bottom cymbal immediately after the foot close sound is generated. The hit sounds correspond to sounds that are generated when the top cymbal is hit with a stick. The expression "sound that corresponds to a sound" means not only the real sound of hi-hat cymbals but also a manipulated sound or a pseudo sound. The term "data" is not limited to digital data on the real sound but may be digital data on a pseudo sound or data on a characteristic quantity used for reproduction of a sound. The recording part 190 may record a plurality of sets of data on the foot close sound, data on the foot open sound and data on hit sounds (1) to (N) in association with vibrations indicated by the vibration information. In that case, for example, the intensity of the vibration or the sound volume, which depends on the intensity of the vibration, can be divided into a plurality of phases, and a different set of data on the foot close sound, data on the foot open sound and data on the hit sounds (1) to (N) can be recorded for each phase. In FIG. 3, the horizontal axis indicates time, and the triangle indicating each sound is a graphical image of an envelope of the sound. A triangle that is short in the horizontal direction means that the sound disappears (tends to attenuate) in a short time. The height of each triangle represents the sound volume. The hit sound (1) represents a hit sound in the close state, and the hit sound (8) represents a hit sound in the open state. The hit sounds (2) to (7) represent hit sounds in half-open states. In this example, N, which is the "predetermined number of states", is 8. Note that the present invention is an invention that relates to hit sounds and therefore can be implemented even if the data on the foot close sound or the data on the foot open sound is not recorded.

The trigger part 120 checks whether the vibration indicated by the vibration information fall within a predetermined range in which a sound generation procedure is to be started (S121). If it is determined that the vibration falls within the range in which the sound generation procedure is to be started, the trigger part 120 starts sound generation procedures for at least all the hit sounds (S124, S125). If a plurality of sets of data on the foot close sound, data on the foot open sound and data on the hit sounds (1) to (8) is recorded in the recording part 190, the trigger part 120 can select a set that corresponds to the intensity of the vibration or the sound volume and start the sound generation procedure. If the trigger part 120 determines that a vibration indicated by new vibration information acquired during the sound generation procedure falls within the predetermined range in which a sound generation procedure is to be started (S121, S122), the trigger part 120 ends the current sound generation procedure (S123) and starts a new sound generation procedure (S124, S125). The expression "a predetermined range in which a sound generation procedure is to be started" means a range in which the relevant vibration is estimated to be caused by a player's intentional operation to produce a sound. The "predetermined range in which a sound generation procedure is to be started" can be appropriately set by considering the type, sensitivity, position of the vibration sensor. Even after the sound generation procedure is started (S124, S125), Steps S112 and S121 are repeated to detect a new vibration. If the answer in Step S121 is Yes, the input part 110 generates an envelope of the distance correction value that depends on the intensity of the vibration indicated by the vibration information, and records the envelope in the recording part 190 (S113). Alternatively, a distance correction value of 0, which is information that indicates there is no distance correction value, may be recorded in the recording part 190, and the distance correction value may be rewritten to a value other than 0 when there is a distance correction value. Furthermore, if an envelope of a distance correction value generated in a previous sound generation procedure is recorded, the envelope of the distance correction value is modified. As a further alternative, in Step S113, the envelope of the distance correction value other than 0 may be generated only when the current state is not the close state. Furthermore, when the current state is the close state, the envelope of the distance correction value may be deleted, or a distance correction value of 0 may be generated.

The sound volume control part 130 generates an output signal by controlling the sound volume of each sound being generated according to the current state information and the information about the change of the distance D between the top pad 910 and the bottom pad 920. When only hit sounds are output, the sound volume can be controlled based only on the current state information. Although, once a sound generation procedure is started, reproduction of at least all the hit sounds is started in the hi-hat cymbal sound generation apparatus 100, a sound whose sound volume is zero is not included in the output signal. The sound volume control part 130 generates the output signal by setting the sound volume of a particular sound at a value other than zero. FIGS. 4 and 5 will be described in detail later.

When changing sounds in response to a change of the distance D, sounds may be changed instantly or by cross-fade. The "cross-fade" refers to gradually increasing the volume of the new sound while gradually decreasing the volume of the previous sound. Cross-fade allows sounds to be more naturally changed. The duration of the cross-fade can be determined according to the rate of the change of states. For example, two cross-fade durations can be set, and one of the cross-fade durations can be selected based on whether the information about the change of the distance D meets a predetermined condition of a quick change. For example, the cross-fade duration may be 10 ms or 20 ms for a quick change and may be 50 ms or 100 ms for a slow change. The sound volume control part 130 controls the sound volume so that the sound volume of the output signal after the change continuously attenuates from the sound volume before the change. When there is no output signal after the change, the sound volume control part 130 may end the sound generation procedure (S310, S128) or continue outputting the sound before the change (S440). When ending the sound generation procedure, the envelope of the distance correction value can be deleted, or the distance correction value can be set at 0.

With the hi-hat cymbal sound generation apparatus 100, the input part 110 acquires the state information by determining the state information based on a corrected distance, which is obtained by adding a distance correction value, which corresponds to the magnitude of the vibration indicated by the vibration information, to the distance indicated by the distance information. That is, with the hi-hat cymbal sound generation apparatus 100, if the top pad is hit hard when the current state is not the close state, the distance is corrected toward the open state depending on the magnitude of the vibration. Therefore, the hi-hat cymbal sound generation apparatus 100 can provide a sound that is closer to the sound of the real hi-hat cymbals.

When the vibration falls within the range in which a sound generation procedure to be started, the hi-hat cymbal sound generation apparatus 100 starts sound generation procedures for at least all the hit sounds. More specifically, all the sounds are generated with the respective envelopes with the respective attacks being synchronized. The output signal responsive to the change of the state is then generated by controlling the sound volume of each sound. In other words, the hi-hat cymbal sound generation apparatus 100 starts the sound generation procedures for at least all the sounds that can be caused by a vibration only when the vibration is caused by the player, and does not start any sound generation procedure but selects sound by controlling the sound volume when no vibration is caused by the player. Through this process, the hi-hat cymbal sound generation apparatus 100 can provide a change of sound close to that of the real hi-hat cymbals.

<Specific Example of Process Performed by Hi-Hat Cymbal Sound Generation Apparatus>

Figure 7:
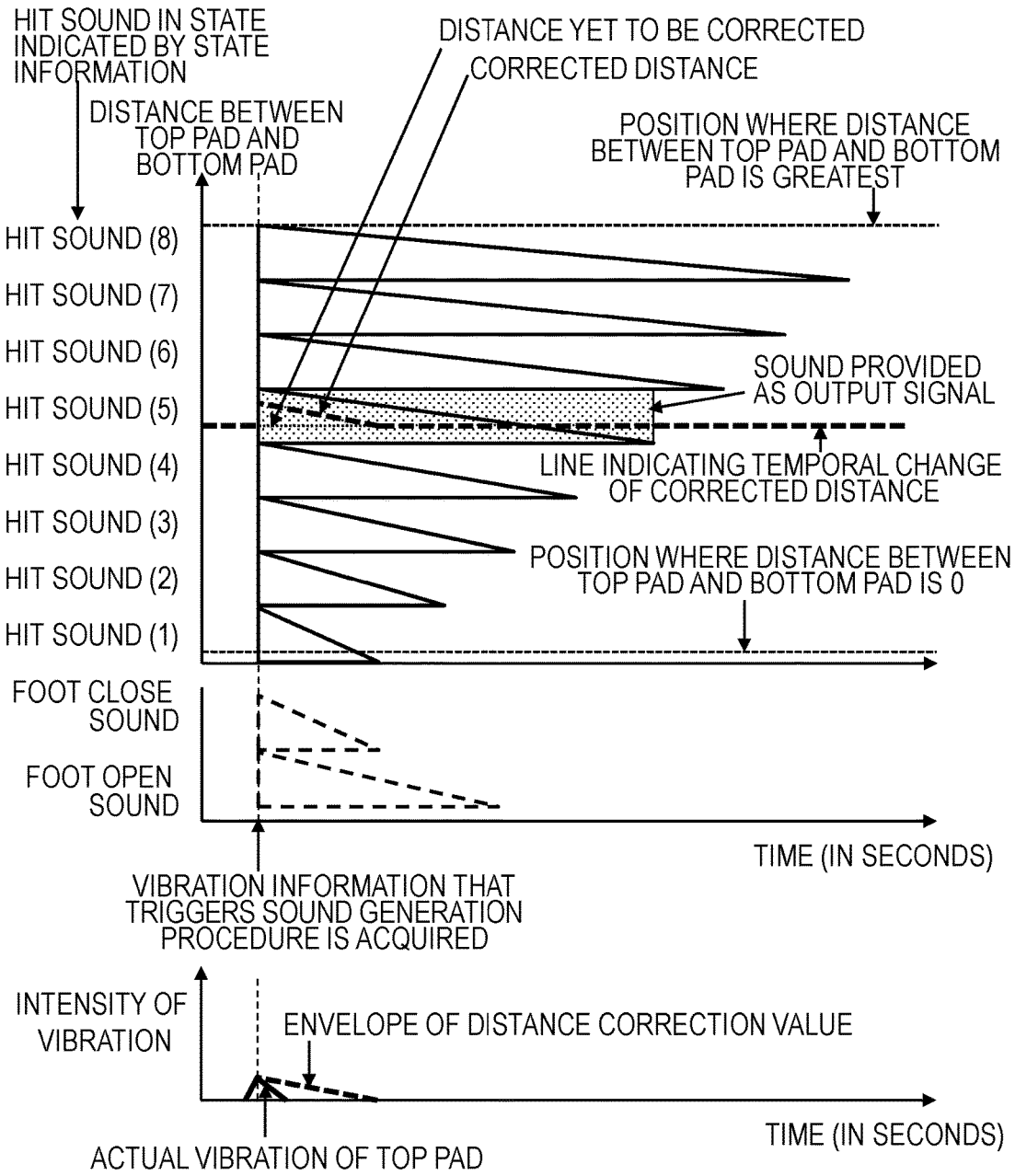
FIG. 7 shows a graphical image of a process performed in a case of a light hit.
Figure 8:
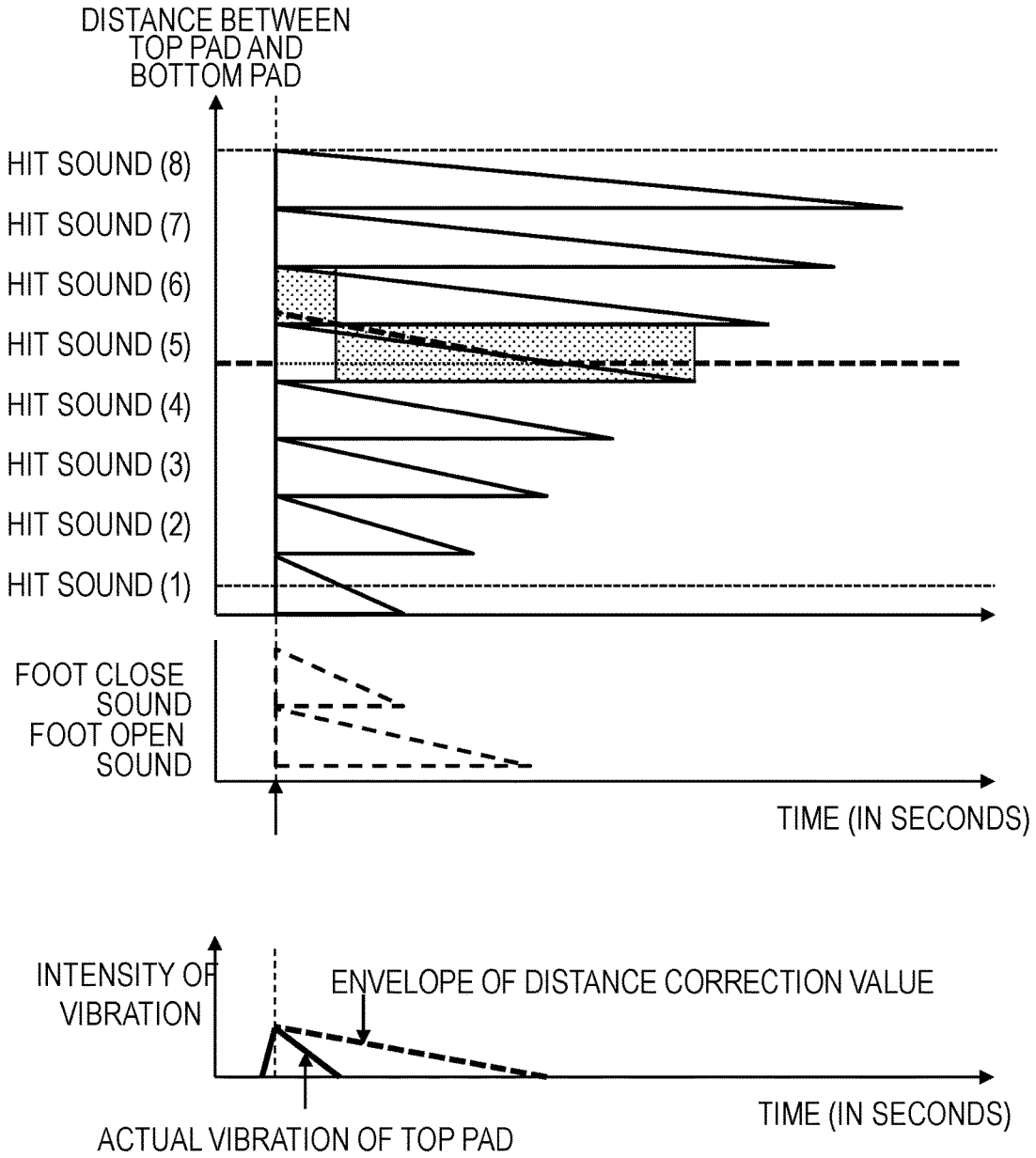
FIG. 8 shows a graphical image of a process performed in a case of a hard hit.
Figure 9:
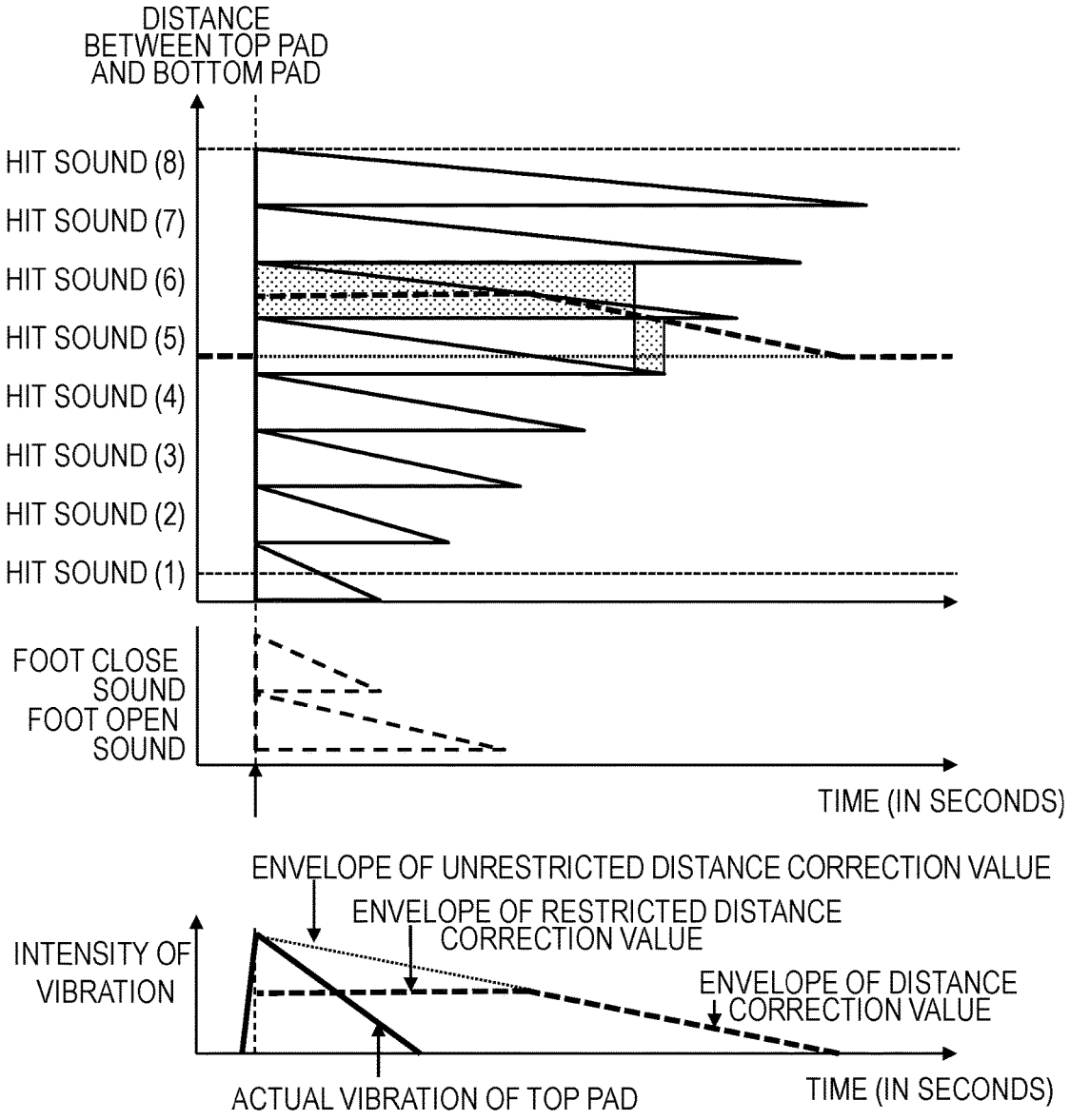
FIG. 9 shows a graphical image of a process performed in a case of a very hard hit.

FIG. 7 shows a graphical image of a procedure performed in a case of a light hit that causes a vibration that falls within the range in which a sound generation procedure is to be started. With reference to FIG. 7, what the graphical image of the process means will also be described. FIG. 8 shows a graphical image of a procedure performed in a case of a hard hit. FIG. 9 shows a graphical image of a procedure performed in a case of a very hard hit.

Next, Step S210 and the following steps in FIG. 4 will be described. At the time for the trigger part 120 to start a sound generation procedure, the sound volume control part 130 checks whether the current state is the close state (S210). If the answer is Yes, it is checked whether the change of the distance D between the top pad 910 and the bottom pad 920 meets a predetermined condition (S220). If the current state is not the close state (No in S210), or if the current state is the close state but the change of the distance between the top pad and the bottom pad does not meet the predetermined condition (if Yes in S210 but No in S220), the trigger part 120 starts the sound generation procedures for all the hit sounds (S125). If a plurality of sets of data on the foot close sound, data on the foot open sound and data on the hit sounds (1) to (8) is recorded in the recording part 190, the trigger part 120 can select a set that corresponds to the intensity of the vibration or the sound volume and start the sound generation procedures for all the hit sounds. The sound volume control part 130 controls the sound volume so that the hit sound in the state indicated by the state information is provided as the output signal (S420). If the current state is the close state, and the change of the distance D between the top pad 910 and the bottom pad 920 meets the predetermined condition (if Yes in S210 and Yes in S220), the trigger part 120 starts the sound generation procedures for the foot close sound, the foot open sound and all the hit sounds (S124). If a plurality of sets of data on the foot close sound, data on the foot open sound and data on the hit sounds (1) to (8) is recorded in the recording part 190, the trigger part 120 can select a set that corresponds to the intensity of the vibration or the sound volume and start the sound generation procedures for the foot close sound, the foot open sound and all the hit sounds. The sound volume control part 130 controls the sound volume so that the foot close sound is provided as the output signal (S410). If the initial sound is a hit sound, neither the foot close sound nor the foot open sound is provided as the output signal until a vibration falling within the range in which a new sound generation procedure is to be started is detected. Therefore, in Step S125, the trigger part 120 does not need to perform the sound generation procedures for the foot close sound and the foot open sound. However, in Step S125, the trigger part 120 can start the sound generation procedures for the foot close sound and the foot open sound.

The "time to start a sound generation procedure" means a time when the initial sound recorded in the recording part 190 can be reproduced. The "predetermined condition" is a condition that the change of the distance D before the sound generation procedure is started is has a momentum (at high rate). This is because the foot close sound is generated when the player presses the pedal 940 down hard to make the top pad 910 hit the bottom pad 920. In other words, the expression "the change of the distance between the top pad and the bottom pad meets a predetermined condition" means that a condition is met that a vibration that falls within a predetermined range in which a sound generation procedure is to be started is caused only by a pedal operation. The determination of whether the "predetermined condition" is met is to check whether the change of the distance D has a momentum, so that the information on the change of the distance D needs to be acquired at short intervals of 5 ms, 10 ms or 15 ms, for example.

Next, FIG. 5 will be described. Once the input part 110 acquires the state information (S111), the hi-hat cymbal sound generation apparatus 100 checks whether a sound generation procedure is being performed (S127). Details of Step S111 are shown in FIG. 6. If a sound generation procedure is being performed (Yes in S127), the hi-hat cymbal sound generation apparatus 100 checks whether there is an output signal (S310), and ends the sound generation procedure (S128) if there is no output signal. If there is an output signal, the hi-hat cymbal sound generation apparatus 100 checks whether there has been a state change (S320), and returns to Step S111 if there has not been a state change. The loop that starts from S111 can be performed at regular intervals (every 5 ins or every 10 ms, for example). At the times other than the time for the trigger part 120 to start a sound generation procedure, the sound volume control part 130 processes the sound volume as described below.

If there has been a state change (Yes in S320), the sound volume control part 130 checks whether the state change is a change from the close state (S330). If the answer in S330 is Yes, the sound volume control part 130 checks whether the foot close sound is being output (S340). If the answer in S340 is Yes, the sound volume control part 130 checks whether a predetermined time has lapsed from the sound generation procedure (S350). By performing these checks, the sound volume control part 130 controls the sound volume as follows.

(1) If the state change is a change from the close state (Yes in S330), the sound volume control part 130

(1-1) controls the sound volume so that the hit sound in the state indicated by the state information after the change is provided as the output signal (S440) when the output signal before the change is the hit sound in the close state (when No in S340), (1-2) controls the sound volume so that the foot open sound is provided as the output signal (S430) when the output signal before the change is the foot close sound and the predetermined time has not lapsed from the start of the sound generation procedure (Yes in S340 and No in S350), and (1-3) controls the sound volume so that the hit sound in the state indicated by the state information after the change is provided as the output signal (S440) when the output signal before the change is the foot close sound as and the predetermined time has lapsed from the start of the sound generation procedure (Yes in S340 and Yes in S350).

If the answer in S330 is No, the sound volume control part 130 checks whether the foot open sound is being output (S360). If the answer in S360 is Yes, the sound volume control part 130 checks whether the state change is a change toward the close state (S370). By performing these checks, the sound volume control part 130 controls the sound volume as follows.

(2) If the state change is a change from a state other than the close state (No in S330), the sound volume control part 130

(2-1) controls the sound volume so that the hit sound in the state indicated by the state information after the change is provided as the output signal (S440) if the state after the change is at least not silence when the output signal before the change is the hit sound in the state indicated by the state information (No in S360), (2-2) continues providing the foot open sound as the output signal (S450) when the output signal before the change is the foot open sound and the change of the state indicated by the state information is not a change toward the close state (Yes in S360 and No in S370), and (2-3) controls the sound volume so that the hit sound in the state indicated by the state information after the change is provided as the output signal (S440) if the state after the change is at least not silence when the output signal before the change is the foot open sound and the change of the state indicated by the state information is a change toward the close state (Yes in S360 and Yes in S370).

The expression "the state after the change is not silence" means that there is the hit sound in the state indicated by the state information after the change. If it sounds unnatural when the state suddenly changes to silence, the sound before the change can continue being output. More specifically, in Step S440, if there is no hit sound in the state indicated by the state information after the change under a predetermined condition, the sound volume control part 130 can continue outputting the hit sound before the change. The "predetermined condition" is a condition that the state after the change is the close state or the half-open state that is the closest to the close state, for example, and the way of controlling the sound volume can be appropriately determined so that the sound naturally attenuates. Furthermore, in S450, the foot open sound continues being provided as the output signal. This can be regarded as no state change. Therefore, the sound volume control part 130 can simply continue the current processing. Furthermore, a change from a state other than the close state may be a change to the close state. If a change to the close state has occurred, a vibration that falls within the predetermined range in which a sound generation procedure is to be started may be detected (S112, S121). If a vibration that falls within the range in which a sound generation procedure is to be started is detected, the trigger part 120 ends the current sound generation procedure (S122, S123), and starts a new sound generation procedure (S124, S125). Therefore, the sound volume control part 130 performs the process (FIG. 4) at the time for the trigger part 120 to start a sound generation procedure. That is, when the top pad 910 comes into contact with the bottom pad 920 slowly enough that no sound generation procedure is started, a state change to the close state occurs and the process (FIG. 5) at a time other than the time for the trigger part 120 to start a sound generation procedure occurs. In that case, the sound volume control part 130 controls the sound volume so that the hit sound (1) that corresponds to the hit sound in the close state is provided as the output signal.

Next, with reference to the graphical image in FIG. 7, what the graphical image of the process performed by the sound volume control part 130 will be described. In the graphical image of the process performed by the sound volume control part 130, the horizontal axis indicates time. FIG. 7 shows that a sound generation procedure is started when "vibration information that triggers a sound generation procedure is acquired". As in FIG. 3, the hit sound (1) represents a hit sound in the close state, the hit sound (8) represents a hit sound in the open state, the hit sounds (2) to (7) represent hit sounds in half-open states, and the triangles represent the envelopes of the sounds. In this example, again, N, which is the "predetermined number N of states", is 8. The vertical axis indicating the hit sounds represents the distance D between the top pad 910 and the bottom pad 920. The position of the hit sound (1) to (8) represents to which of the eight states the distance D corresponds. The hit sounds (1) to (8) represents the hit sounds in the respective states. To make the height of the envelopes of the sounds uniform, all the hit sounds (1) to (8) have the same range. In actual, however, the distance D is smallest in the state where the hit sound (1) is output and increases as the sound changes toward the hit sound (8). That is, the vertical axis does not accurately represent the distance D but only shows states at greater distances at higher positions.

The position where the distance D is 0 is shown by a dotted line below the range of the hit sound (1). The dotted line shown above the hit sound (8) indicates the position where the distance D between the top pad 910 and the bottom pad 920 is greatest. In the graph shown at the bottom of the drawing, the vertical axis indicates the intensity of the vibration, the solid line indicates the vibration of the top pad 910 detected by the vibration sensor 915, and the thick dotted line indicates the distance correction value generated by the input part 110 in Step S113. The thick dotted line shown in the range of the hit sound (5) indicates a temporal change of the corrected distance D. The distance D yet to be modified by the correction is shown by a thin dotted line.

In the example shown in FIG. 7, the player lightly hits the top pad 910 while operating the pedal 940 to keep the distance D between the top pad 910 and the bottom pad 920 uniform. Since the hit is light, the state indicated by the state information remains in the state in which the hit sound (5) is generated after the correction. The shaded region indicates the sound provided as the output signal. In the example shown in FIG. 7, the current state at the time to start a sound generation procedure is not the close state (No in S210), so that the trigger part 120 starts the sound generation procedures for at least all the hit sounds (1) to (8) (S125). The sound volume control part 130 provides the hit sound (5) that corresponds to the hit sound in the state indicated by the state information as the output signal (S420). The initial sound volume can be determined in accordance with the intensity of the vibration. Although the sound generation procedures do not involve the envelopes of the foot close sound and the foot open sound, the envelopes can be involved in the sound generation procedure and are therefore shown by dotted lines.

In the example shown in FIG. 8, the player hits the top pad 910 hard while operating the pedal 940 to keep the distance D between the top pad 910 and the bottom pad 920 uniform. Since the hit is hard, the distance correction value generated by the input part 110 in Step S113 is greater than the value in FIG. 7. The initial part of the corrected distance D is in the state where the hit sound (6) is output. Therefore, the sound volume control part 130 controls the sound volume so that the sound changes from the hit sound (6) to the hit sound (5) with the sound volume corresponding to the vibration. The change of the sound can be achieved by cross-fade as described above.

In the example shown in FIG. 9, the player hits the top pad 910 very hard while operating the pedal 940 to keep the distance D between the top pad 910 and the bottom pad 920 uniform. If there is no upper limit on the distance correction value, the state in which the hit sound (7) is output is also modified as a result of the correction of the distance D. However, such a change does not occur in the real hi-hat cymbals, so that the input part 110 can impose a restriction concerning the upper limit on the distance correction value. In the graph indicating the intensity of the vibration in FIG. 9, the thick dotted line indicates an envelope of a restricted distance correction value, and the thin dotted line indicates an envelope of an unrestricted distance correction value. Since the hit is very hard, the distance correction value lasts for a longer time than in FIG. 8. Therefore, the sound volume control part 130 controls the sound volume so that the sound changes from the hit sound (6) to the hit sound (5) with the sound volume corresponding to the vibration after the hit sound (6) is output for a longer time than in FIG. 8. The change of the sound can be achieved by cross-fade as described above.

Figure 10:
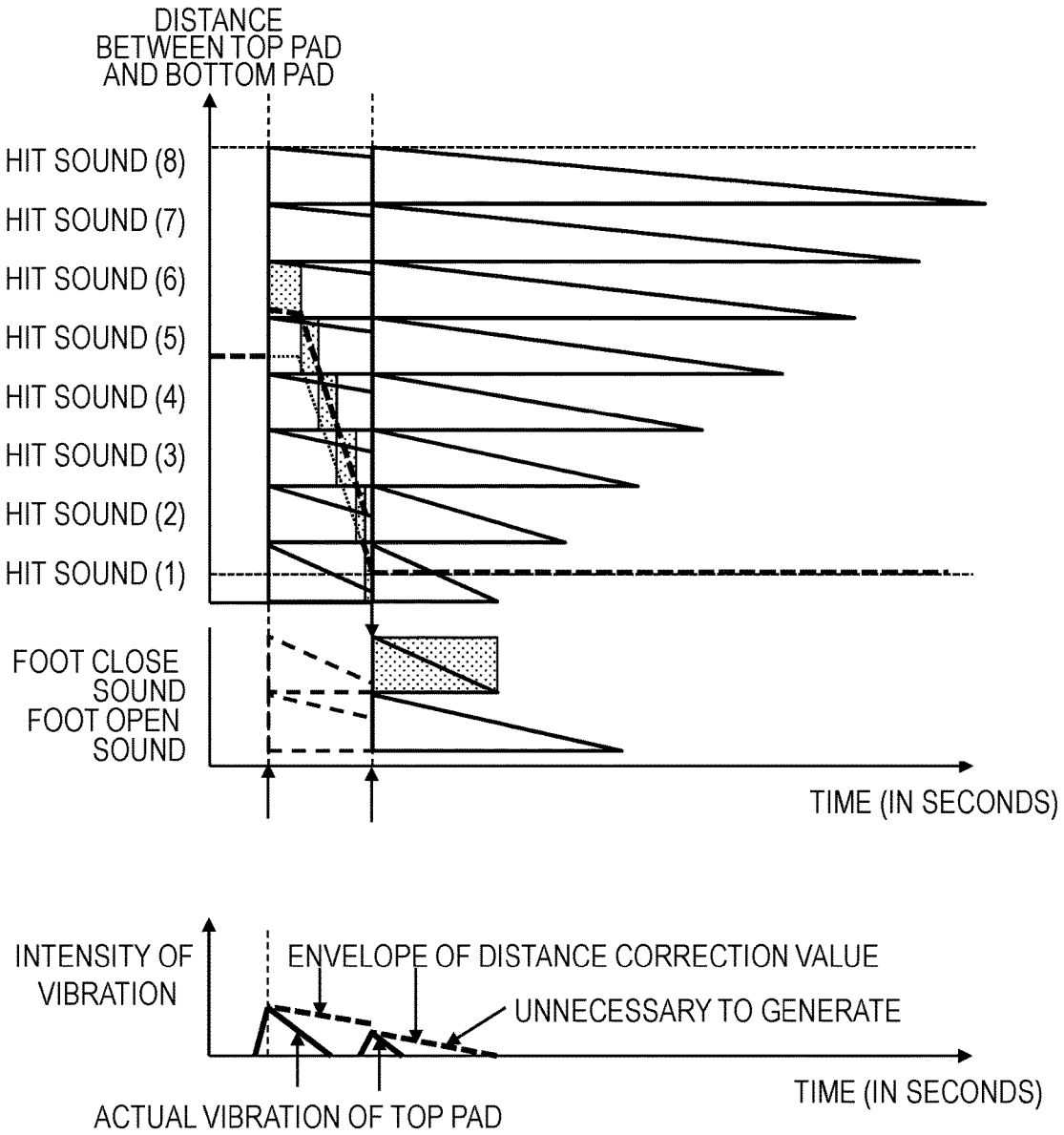
FIG. 10 shows a graphical image of a first process performed when the state changes to a close state after a hard hit.

FIG. 10 shows a graphical image of a procedure of performed when the state changes to the close state at a such rate that the foot close sound is generated after the top pad 910 is hit hard. Since the current state at the time to start a sound generation procedure is not the close state (No in S210), the trigger part 120 starts the sound generation procedures for at least all the hit sounds (1) to (8) (S125). The sound volume control part 130 provides the hit sound (6), which corresponds to the hit sound in the state determined by the corrected distance, as the output signal (S420). After that, the state changes as the player operates the pedal 940. However, since the state change is a change from a state other than the close state (No in S330), and the hit sound in the state indicated by the state information before the change is being provided as the output signal (No in S360), the sound volume control part 130 controls the sound volume so that the hit sound in the state indicated by the state information after the change is provided as the output signal (S440). Therefore, the sound changes from the hit sound (6) to the hit sound (5), from the hit sound (5) to the hit sound (4), from the hit sound (4) to the hit sound (3), and then from the hit sound (3) to the hit sound (2). When the distance D yet to be corrected becomes the distance that corresponds to the close state (Yes in S115), the sound changes to the hit sound (1) since the state information is determined without addition of the distance correction value. During this change, the height of the envelopes shown in FIG. 8 abruptly decreases. In view of this, when the state changes toward the close state, the sound volume control part 130 can control the sound volume so as to continuously attenuate by increasing a scaling factor of the sound volume of the output signal against the decreasing height of the envelopes.

When the distance D becomes 0, a vibration that falls within the predetermined range in which a sound generation procedure is to be started is detected (S112, S121), and the current sound generation procedure is ended (S122, S123). Since the current state is the close state, and the change of the distance meets the predetermined condition (Yes in S210 and Yes in S220), the trigger part 120 starts the sound generation procedures for the foot close sound, the foot open sound and all the hit sounds (1) to (8) (S124), and the sound volume control part 130 controls the sound volume so that the foot close sound is provided as the output signal (S410). The graph showing the intensity of the vibration in FIG. 10 shows an example in which the input part 110 generates an envelope of the distance correction value even when a vibration occurs in the close state. However, when a vibration occurs in the close state, the input part 110 does not need to generate an envelope of the distance correction value.

Figure 11:
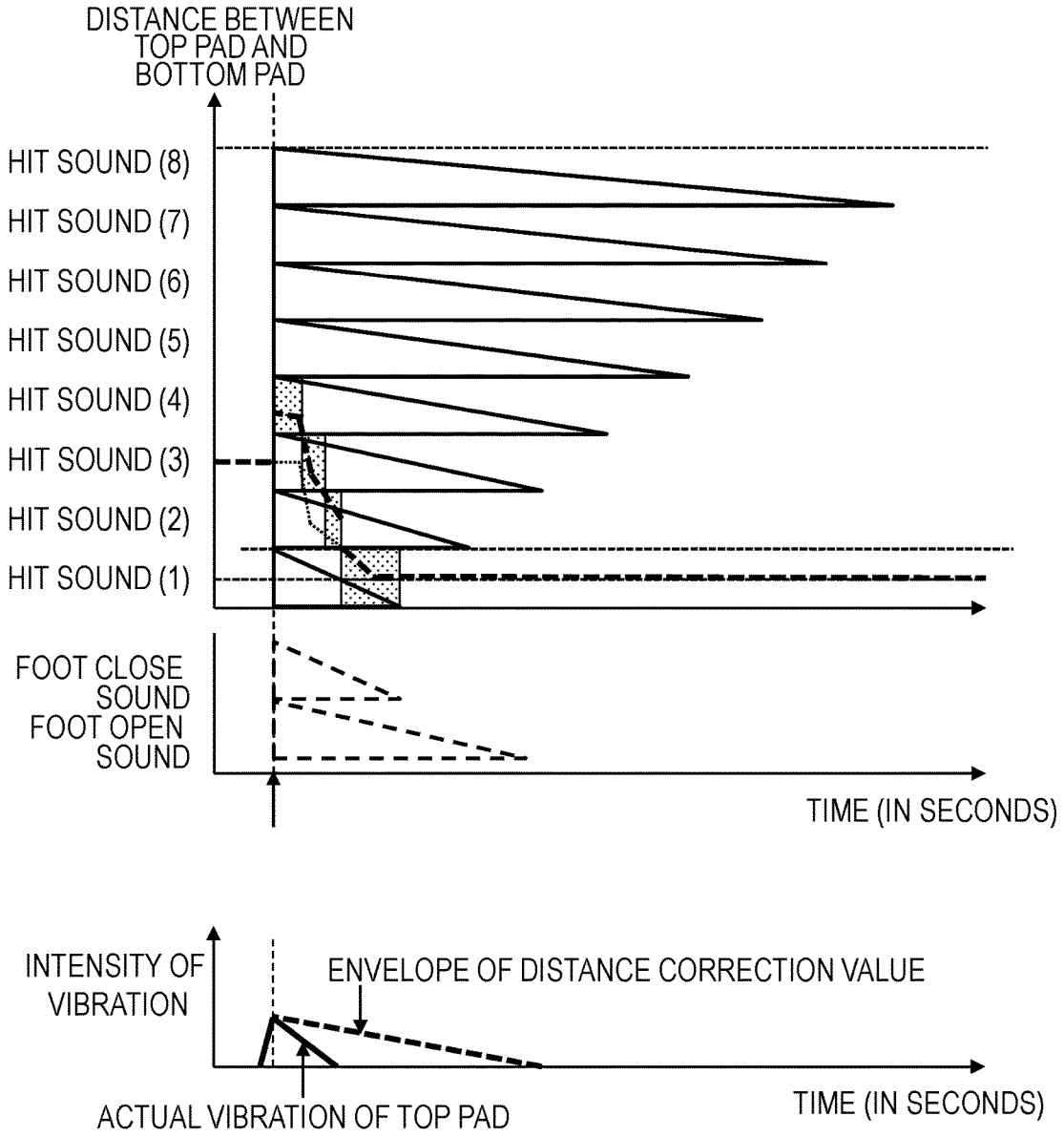
FIG. 11 shows a graphical image of a second process performed when the state changes to a close state after a hard hit.

FIG. 11 shows a graphical image of a procedure performed when, although the state changes to toward the close state after the top pad 910 is hit hard, there is no vibration that falls within the predetermined range in which a sound generation procedure is to be started when the distance D becomes 0. In this example, the corrected distance at the start of the sound generation procedure corresponds to the state in which the hit sound (4) is output, so that the sound changes from the hit sound (4) to the hit sound (3), and then from the hit sound (3) to the hit sound (2). When the distance D yet to be corrected becomes the distance that corresponds to the close state (Yes in S115), the sound changes to the hit sound (1) since the state information is determined without addition of the distance correction value. After that, the distance D becomes 0. However, since no vibration is detected that falls within the predetermined range in which a sound generation procedure is to be started (S112, S121), the sound volume control part 130 continues outputting the hit sound (1), and the sound generation procedure ends when the hit sound (1) disappears. When ending the sound generation procedure, the envelope of the distance correction value can be deleted, or the distance correction value can be set at 0.

Although the process flows in FIGS. 4 and 5 show cases where the foot open sound is output, the present invention is an invention that relates to providing hit sounds closer to those of the real hi-hat cymbals, and therefore descriptions of the foot open sound with reference to the graphical images of procedures are omitted.

With the hi-hat cymbal sound generation apparatus 100, the input part 110 acquires the state information by determining the state information based on a corrected distance, which is obtained by adding a distance correction value, which corresponds to the magnitude of the vibration indicated by the vibration information, to the distance indicated by the distance information. That is, with the hi-hat cymbal sound generation apparatus 100, if the top cymbal is hit hard when the current state is not the close state, the distance is corrected toward the open state depending on the magnitude of the vibration. Therefore, the hi-hat cymbal sound generation apparatus 100 can provide a sound that is closer to the sound of the real hi-hat cymbals.

[Program and Recording Medium]

The various processings described above are not necessarily sequentially performed in the temporal order described above but can also be performed in parallel with or separately from each other depending on the processing capacity of the apparatus that performs the processings or as required. As required, of course, modifications can be made without departing from the spirit of the present invention.

When computer (a processing circuit) implements the arrangement described above, the specific processings of the functions that the apparatus needs to have are described in a program. The computer executes the program, thereby implementing the processing functions described above.

The program that describes the specific processings can be recorded in a computer-readable recording medium. The computer-readable recording medium may be any recording medium, such as a magnetic recording device, an optical disk, a magneto-optical recording medium, or a semiconductor memory.

The program is distributed by selling, transferring or loaning a portable recording medium, such as a DVD or a CD-ROM, in which the program is recorded, for example. Alternatively, the program may be stored in a storage unit in a server computer and distributed by transferring the program from the server computer to another computer via a network.

The computer that executes the program first temporarily stores, in a storage medium thereof, the program recorded on a portable recording medium or transferred from a server computer, for example. To perform the processings, the computer reads the program from the recording medium and performs the processings according to the read program. Alternatively, the computer may read the program directly from the portable recording medium and perform the processings according to the program, or the computer may perform the processings according to the program each time the computer receives a new program transferred from the server computer. As a further alternative, the processings described above may be performed on an application service provider (ASP) basis, in which the server computer does not transfer the program to the computer, and the processing functions are implemented only through execution instruction and result acquisition. The program according to this embodiment includes a quasi-program, which is information used in processings by a computer (such as data that is not a direct instruction to a computer but has a property that defines the processings performed by the computer).

Although the apparatus according to this embodiment has been described as being implemented by a computer executing a predetermined program, at least part of the specific processings may be implemented by hardware.

What is claimed is:

1. A hi-hat cymbal sound generation apparatus that generates a sound of hi-hat cymbals based on information on an operation to a top pad, which corresponds to a top cymbal, and a bottom pad, which corresponds to a bottom cymbal, the top pad and the bottom pad being attached to a hi-hat stand with a pedal, wherein a distance between the top pad and the bottom pad is capable of being changed by an operation of the pedal, state information is information that indicates which of a predetermined number of states a state is, the state being determined by the distance between the top pad and the bottom pad, of the states, a state in which the top pad and the bottom pad are closest to each other is designated as a close state, the hi-hat cymbal sound generation apparatus comprises:

an input part that acquires distance information, which is information on a distance between the top pad and the bottom pad, the state information and vibration information, which is information on a vibration of the top pad;

a recording part that records data on the predetermined number of hit sounds that correspond to sounds caused by hitting in the states indicated by the state information;

a trigger part that checks whether the vibration indicated by the vibration information falls within a predetermined range in which a sound generation procedure is to be started, and starts a sound generation procedure for at least all the hit sounds when the trigger part determines that the vibration falls within the range in which a sound generation procedure is to be started; and a sound volume control part that controls a sound volume of each of the hit sounds according to current state information, and the input part acquires the state information by determining the state information based on a corrected distance, which is obtained by adding a distance correction value, which corresponds to a magnitude of the vibration indicated by the vibration information, to the distance indicated by the distance information.

2. A hi-hat cymbal sound generation apparatus according to claim 1, wherein the distance correction value is at a maximum when the sound generation procedure is started and attenuates with a predetermined envelope.

3. A hi-hat cymbal sound generation apparatus according to claim 1, wherein the state indicated by the state information determined based on the corrected distance is limited to a state that is the same as the state indicated by the state information determined based on the distance yet to be corrected or a state that is one state closer to an open state.

4. A hi-hat cymbal sound generation apparatus according to claim 1, wherein the recording part records a plurality of sets of data on the predetermined number of hit sounds, and the trigger part starts a sound generation procedure by selecting a set of data that corresponds to an intensity of the vibration or the sound volume.

5. A hi-hat cymbal sound generation method of generating a sound of hi-hat cymbals based on information on an operation to a top pad, which corresponds to a top cymbal, and a bottom pad, which corresponds to a bottom cymbal, the top pad and the bottom pad being attached to a hi-hat stand with a pedal, wherein a distance between the top pad and the bottom pad is capable of being changed by an operation of the pedal, state information is information that indicates which of a predetermined number of states a state is, the state being determined by the distance between the top pad and the bottom pad, of the states, a state in which the top pad and the bottom pad are closest to each other is designated as a close state, data on the predetermined number of hit sounds that correspond to sounds caused by hitting in the states indicated by the state information is previously recorded in a recording part, the hi-hat cymbal sound generation method comprises:

an input step of acquiring distance information, which is information on a distance between the top pad and the bottom pad, the state information and vibration information, which is information on a vibration of the top pad;

a trigger step of checking whether the vibration indicated by the vibration information falls within a predetermined range in which a sound generation procedure is to be started, and starting a sound generation procedure for at least all the hit sounds when it is determined that the vibration falls within the range in which a sound generation procedure is to be started; and a sound volume control step of controlling a sound volume of each of the hit sounds according to current state information, and in the input step, the state information is acquired by determining the state information based on a corrected distance, which is obtained by adding a distance correction value, which corresponds to a magnitude of the vibration indicated by the vibration information, to the distance indicated by the distance information.

6. A hi-hat cymbal sound generation method according to claim 5, wherein the distance correction value is at a maximum when the sound generation procedure is started and attenuates with a predetermined envelope.

7. A hi-hat cymbal sound generation method according to claim 5, wherein the state indicated by the state information determined based on the corrected distance is limited to a state that is the same as the state indicated by the state information determined based on the distance yet to be corrected or a state that is one state closer to an open state.

8. A hi-hat cymbal sound generation method according to claim 5, wherein the recording part records a plurality of sets of data on the predetermined number of hit sounds, and the trigger step starts a sound generation procedure by selecting a set of data that corresponds to an intensity of the vibration or the sound volume.

9. A computer-readable non-temporary recording medium in which a hi-hat cymbal sound generation program is recorded, the hi-hat cymbal sound generation program making a computer function as the hi-hat cymbal sound generation apparatus according to claim 1.

* * * * *